United States Patent [19]

Jenne

[11] Patent Number: 4,751,795

[45] Date of Patent: Jun. 21, 1988

[54] KNIFE SHARPENER

[76] Inventor: Walter F. Jenne, 505 Briarwood La., Elk Grove Village, Ill. 60007

[21] Appl. No.: 823,061

[22] Filed: Jan. 27, 1986

[51] Int. Cl.[4] ..... B24D 15/08

[52] U.S. Cl. ..... 51/205 WG; 51/214; 51/181 R; 51/354; 76/86; 76/88

[58] Field of Search ..... 51/205 WG, 205 R, 211 R, 51/150, 156, 354, 212, 214, 285; 76/86, 82, 82.2, 88

[56] References Cited

U.S. PATENT DOCUMENTS

| | | | |
|---|---|---|---|
| 67,011 | 7/1867 | Young | 76/86 |
| 1,075,110 | 10/1913 | Klusewitz | 76/88 |
| 2,460,552 | 2/1949 | Tarapczynski | 51/354 |
| 2,749,678 | 6/1956 | Jahn | 51/354 |
| 4,272,925 | 6/1981 | Graves | 51/211 R |
| 4,530,188 | 7/1985 | Graves | 51/181 R |

FOREIGN PATENT DOCUMENTS

| | | | |
|---|---|---|---|
| 0962765 | 6/1950 | France | 51/354 |
| 0869491 | 5/1961 | United Kingdom | 51/214 |

*Primary Examiner*—Frederick R. Schmidt
*Assistant Examiner*—Robert A. Rose

[57] ABSTRACT

A crossed abrasive rod manual knife sharpener that can be rigidly supported on readily available with only light hand pressure and in other positions with the user's supporting hand well away from the sharpening area, and that is provided with a knife-blade alignment site and supporting surface edge guides.

12 Claims, 3 Drawing Sheets

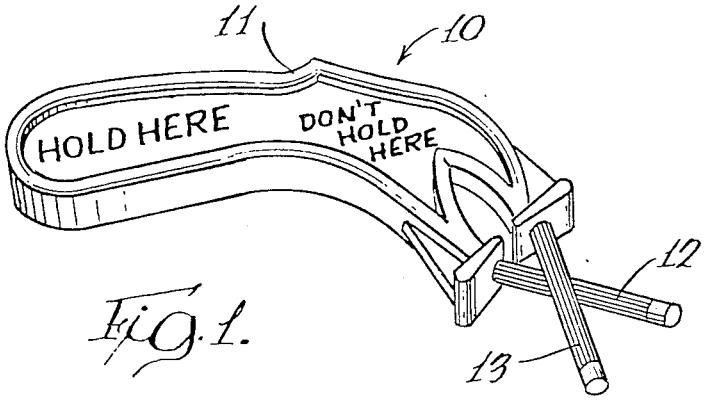
Fig. 1.
Fig. 2.
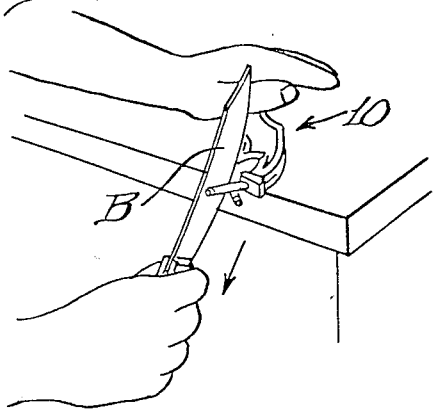
Fig. 3.
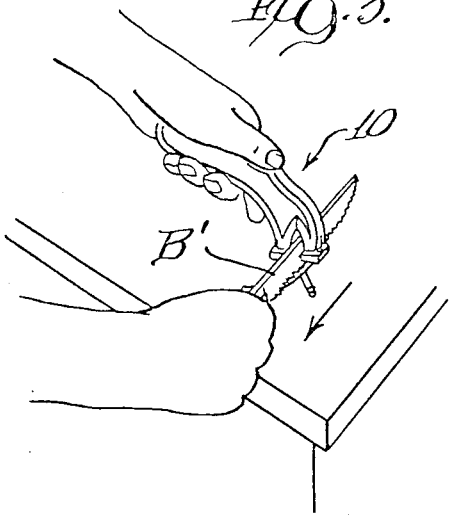
Fig. 4.
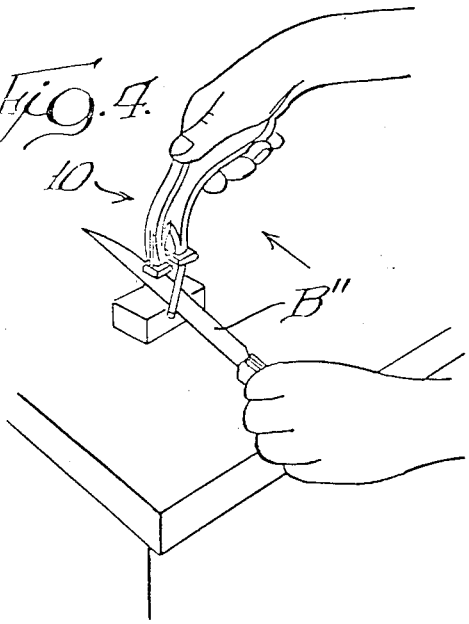
Fig. 5.
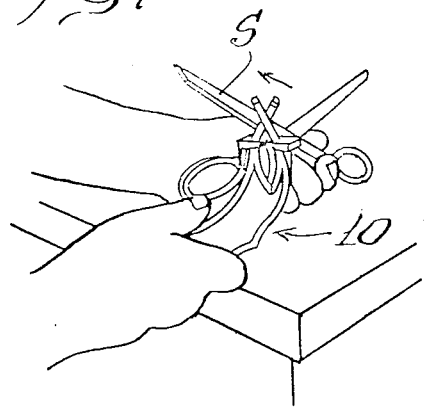

KNIFE SHARPENER

BACKGROUND OF THE PRESENT INVENTION

There have in the past been provided a plurality of manual knife sharpening instruments that have achieved a considerable degree of commercial success and one such knife sharpening device includes a pair of crossed abrasive rods usually constructed of compressed ceramic or graphite powder, or in some cases serrated hardened steel. One of these is a table-mounted implement having a wooden base with a plurality of angularly related holes in the base that removably receive the abrasive rods. The base is rectangular and elongated and the user manually grasps one end of this base and forces it down against the supporting surface or table with the rods diverging generally vertically upwardly. This knife sharpening device has been found quite adequate, but it is not readily portable and in some positions of the device the user's supporting hand, i.e. the hand on the base, is somewhat close to the knife sharpening area subjecting it to some physical risk.

Another knife sharpening device that has found some success in the marketplace is a crossed abrasive rod sharpener having a short plastic handle. This device has also achieved considerable success in the marketplace and is reasonably safe but it does have the disadvantage that it cannot be supported readily on available supporting surfaces and it is also somewhat difficult to align with respect to the knife blade surfaces to be sharpened.

It is a primary object of the present invention to provide an improved manual knife sharpening instrument that obviates the problem noted above in prior art knife sharpening devices.

SUMMARY OF THE PRESENT INVENTION

According to the present invention, an improved manual knife sharpening tool is provided that has a generally planar, elongated plastic handle or frame that permits the sharpener to be supported and used in a variety of effective positions with the user's hand well out of the way of the knife sharpening area and with relatively light manual pressure. The frame is arcuate in configuration and is bifurcated at one end defining a pair of support posts in which crossed knurled hardened steel rods are insert molded. The bifurcated handle or frame posts define converging surfaces extending away from the rods that form a line-of-site for the user when sharpening a blade between the two rods.

These support posts also have aligned transverse projecting surfaces that are adapted to engage the side edges of a table or the like when the frame is supported on top of the table with the rods projecting over its edge. These surfaces align the rods so that a line bisecting the rods is perpendicular to the table edge permitting the user to have an accurate feel as to blade orientation with respect to the rods.

With this improved knife sharpener and in part due to the some six inch arcuate length of the sharpener and its planar configuration, the frame may be supported on top of a table or another rigid horizontal surface with the rods extending over the edge of the surface and the knife sharpened with only very light downward hand pressure on the handle.

Other objects and advantages of the present invention will become apparent from the following detailed description.

BRIEF DESCRIPTION OF THE DRAWINGS

FIG. 1 is a perspective view of the present knife sharpener;

FIG. 2 is a perspective view of the present knife sharpener supported on a horizontal surface;

FIG. 3 is a perspective of the present knife sharpener in a position to sharpen wavy or serrated edges;

FIG. 4 is a perspective view of the present knife sharpener in a position to sharpen fillet knives or odd-shaped knife blades;

FIG. 5 is a perspective view of the present knife sharpener in a position to sharpen scissors;

DETAILED DESCRIPTION OF THE PREFERRED EMBODIMENT

Figure 6:
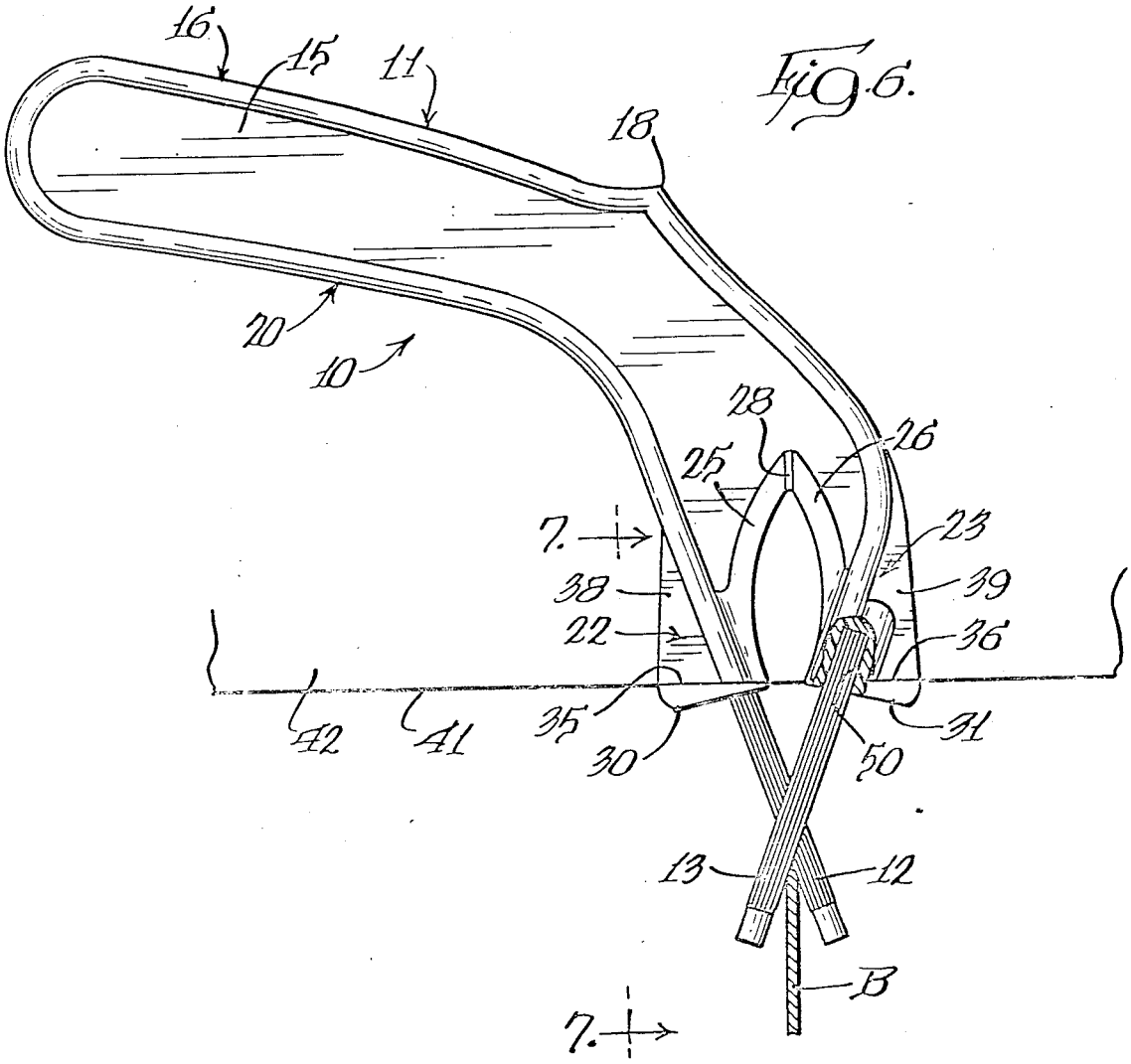
FIG. 6 is an enlarged top view of the present knife sharpener supported on a horizontal surface.
Figure 7:
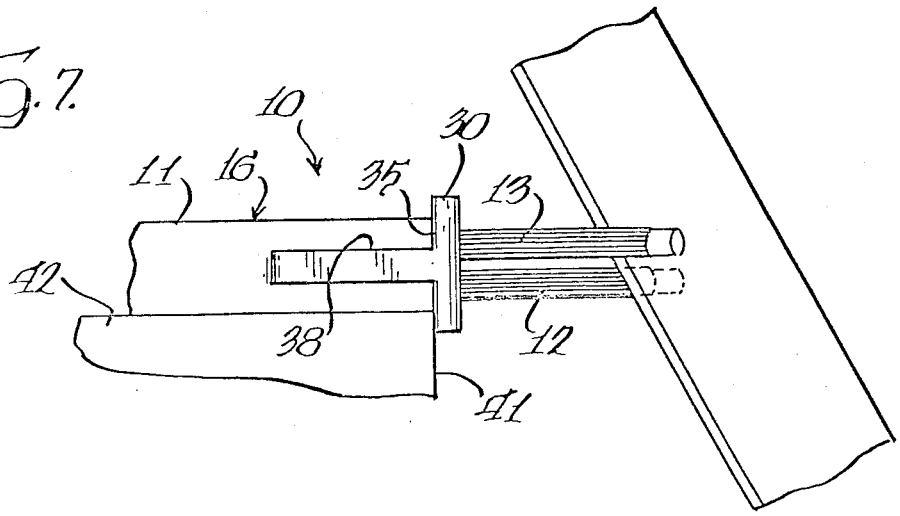
FIG. 7 is a fragmentary section generally along line 7—7 of FIG. 6.

Referring to the drawings and particularly to FIGS. 1, 6 and 7, the present knife sharpening device 10 is seen to include an elongated planar plastic frame or handle 11 and crossed axially knurled hardened steel rods 12 and 13. As seen clearly in FIGS. 6 and 7, the rods 12 and 13 have axes lying and spaced parallel planes in the plane of FIG. 7 with the axes being crossed in the plane of FIG. 6 at an included angle of approximately 40 degrees.

The handle or frame 11 may be construed of an injection-moldable high-impact thermoplastic such as A.B.S., polypropylene or "Delrin" and as seen in FIGS. 6 and 7 includes a thin central web 15 approximately 3/16" surrounded by a transverse peripheral rim having a width of approximately 9/16".

The entire handle 16 has an arcuate length of approximately 7 inches along its center line so that the user's hand may be positioned well away from the rods 12 and 13 during sharpening. Rib 16 has a gentle apex approximately midway along its length at 18 that defines a pistol grip portion 20 for the handle 11. Pistol grip portion 20 is generally aligned with the rods 12, 13 so that the center line of pistol grip portion 20 intersects a line bisecting the rods 12, 13 at an angle of approximately 105 degrees.

The forward end of the frame 11 is bifurcated and defines support posts 22 and 23 with undersized bores 50 into which rods 12 and 13 are pressed during assembly. The posts 12 and 13 have reduced arcuate rim portions 25 and 26 converging away from the rods 12 and 13 to an apex 28. The apex 28 lies on a line coincident with the line bisecting the rods 12 and 13 in the plane of FIG. 6. Apex 28 and converging rim portions 25 and 26 form a line of sight device to assist the user in aligning blade B (FIG. 6) on the line bisecting the rods 12, 13 so that both blade edges are ground or sharpened to equal angles.

The handle projections 22 and 23 have transverse projections 30 and 31 at their ends that extend outwardly beyond the rim 16, as seen clearly in FIG. 7. The projections 30 and 31 have aligned transverse edge-engaging surfaces 35 and 36 that extend in both directions from the web portions 38 and 39, both of which are in planar alignment with the main web 15 of the handle 11.

The transverse surfaces 35 and 36 are perpendicular to the plane of the handle 11 and also perpendicular to a plane extending parallel to and between the rods 12 and 13 perpendicular to the plane of FIG. 7. The edge surfaces 35 and 36, or more aptly termed "edge guides", when positioned in engagement with an edge 41 of a supporting surface 42, serve to align the rods 12 and 13 in a position so that the line bisecting the axes of the rods is perpendicular to edge 41, and they also and perhaps more importantly serve to support the entire knife sharpener against the force of edge 41 as seen in FIGS. 6 and 7.

The sharpener 10 is illustrated in FIG. 2 in its table-mount position for sharpening conventional household as well as hunting knives. The sharpener 10 is placed with its handle 11 flat on the table with edge guides 35 and 36 resting against the table edge and this holds the sharpener securely at a right angle to the table. The handle is held down with the one palm on the pistol grip area 20 and then with the other hand the user puts one knife edge against the crossed rods 12 and 13. The user then begins sharpening at the handle end of the blade, pulling down with mild pressure, using less pressure as the knife gets sharper.

In this position the knife edges also can be simultaneously sharpened between the rods as seen in FIG. 6 using the sight alignment apex 28 as a visual guide.

In FIG. 3 the knife sharpener 10 is shown in the generally vertical position with the rod ends against the table and this is particularly suitable for sharpening knives with wavy or serrated edges. The blade is placed between the rods 12, 13 and between the posts 22 and 23 and the user pulls the knife through the opening between the posts in engagement with both rods on the line bisecting the axis of the rods.

In FIG. 4 the knife sharpener 10 is illustrated in a position particularly designed to sharpen curved blades, fillet knives or other odd-shaped blades. In this position, the back edge of the knife is supported on a block or the like and with the knife sharpener in a generally vertical position with the thumb resting on the thumb guide 18, the rods 13 and 14 are impaled over the knife B and the sharpener is dragged from the heel of the blade to the point.

Scissors may also be sharpened when the sharpener 10 is utilized in the position as shown in FIG. 5. One of the rods is drawn across each of th scissor blades from the pivot point towards the user several times.

It is also possible because of the press fit of rods 12 and 13 in bores 50 to remove the rods with the assistance of a vice from the posts 22 and 23, rotate them slightly and then replace in the projections to provide a new sharpening surface. This secondary locking is possible because the axially knurled rods 12 and 13 provides irregular holes 50 in the posts that lock on the rods 12 and 13 when reinserted.

Figure 8:
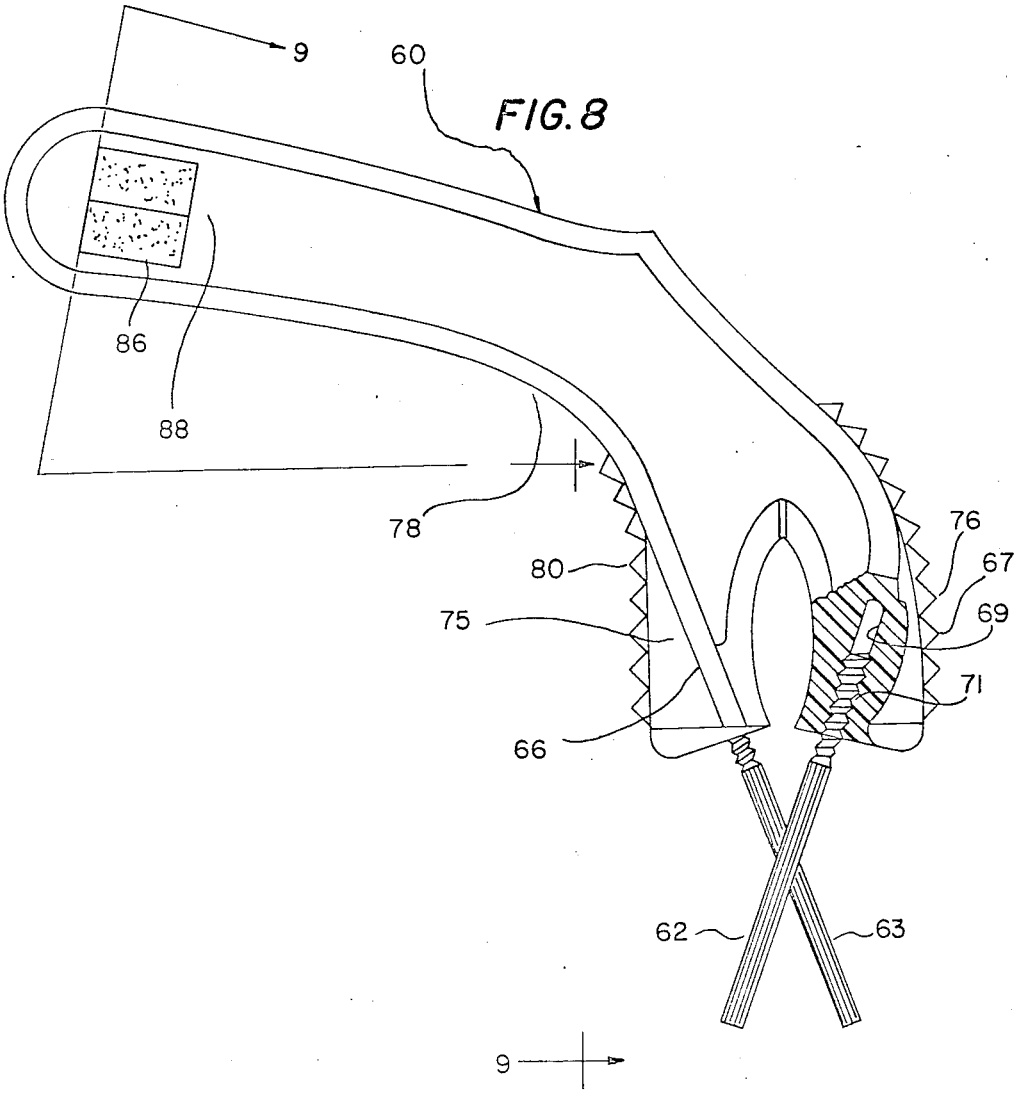
Figure 9:
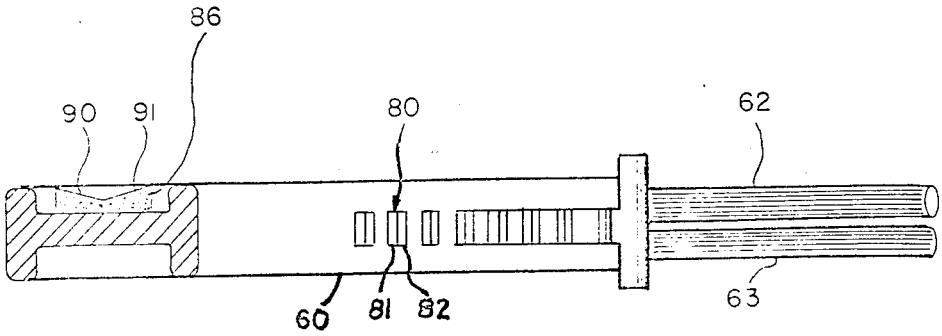

In FIGS. 8 and 9 an alternative form of the present knife sharpener is illustrated and is seen to include a handle 60 having the same general configuration as the handle 11 in the FIGS. 1 to 7 embodiment, and crossed knurled steel rods 62 and 63. As in the FIGS. 1 to 7 embodiment the forward end of the handle is bifurcated and defines support posts 66 and 67 for the rods 63 and 62 respectively. Support posts 66 and 67, however, are somewhat longer. The bosses 66 and 67 have core-formed cylindrical bores 69 therein that are approximately one-quarter inch longer than the inner ends of the rods 62 and 63 when installed during manufacture.

The rods 62 and 63 are formed with self-tapping threads 71, part of which project from the bosses 66 and 67 when originally installed. After the original active surfaces on rods 62 and 63 have become worn after sharpening for a period of time, the user rotates the rod 62 and 63 with pliers or vise threading the threaded portion 71 into bores 69 and exposing new fresh surfaces on the rods for sharpening. Because the lead on the self-tapping portion 71 is substantial, after one to three 360 degree turns of the rods 62 and 63, the original worn areas on the rods 62 and 63 will not be in an active sharpening position anymore since the rods will cross at a point closer to their distal ends as the rods are threaded further in bores 69. This combined rotational and axial movement of the rods 62 and 63 enables much greater surface areas on the rods to be utilized as sharpening surfaces.

To further deter the user from hand-grasping the handle 60 adjacent the rods or steels 62 or 63, web portions 75 and 76 and portions of rim 78 have integrally molded sharp barbs 80 defined as seen in FIG. 9 by flat planar surfaces 81 and 82 that intersect along a lineal apex.

The FIGS. 8 and 9 embodiment also has the addition of a fish hook and sewing needle grinding stone 86 bonded to handle web portion 88 near its distal end. Stone 86 is gnerally rectangular in configuration and has a shallow V-shaped upper surface defined by surface portions 90 and 91 that facilitate hook sharpening.

I claim:

1. A knife sharpening instrument comprising: an elongated generally planar frame member, said frame member being bifurcated at one end thereof defining spaced support posts, a first abrasive rod having an axis mounted in one of the support posts, and a second abrasive rod having an axis mounted in the other support post so that the axes of the rods cross in at least one plane, said rods extending a substantial distance away from the frame member beyond the point where they cross so that a knife may be sharpened by directing the edge thereof toward the frame member, said frame member having a completely flat surface on at least one side thereof so it may be supported on a flat horizontal supporting surface, said frame member having edge support means for aligning the frame member with an edge of a horizontal supporting surface so that the rods project over the edge, said edge support means including at least one surface on the support posts extending perpendicular to a line bisecting the axes of the rods and outwardly from the plane of the frame member and facing away from the rods so that it may engage the edge of the horizontal supporting surface and oppose the force of a knife engaging the rods with the knife edge pointed toward the frame member.

2. A knife sharpening instrument as defined in claim 1, wherein the frame member has an arcuate length at least three times the length of the rods so that the user's supporting hand on the frame member may be placed well away from the rods.

3. A knife sharpening instrument as defined in claim 1, wherein the edge support means includes a lateral projection on each of the support posts extending generally transversely outwardly from the plane of the frame member.

4. A knife sharpening instrument comprising: an elongated generally arcuate and planar frame member, said frame member being bifurcated at one end thereof defining spaced support posts, a first abrasive rod having an axis mounted in one of the support posts, and a second abrasive rod having an axis mounted in the other support post so that the axes of the rods cross in at least one plane, said frame member having edge support means for aligning the frame member with an edge of a horizontal supporting surface so that the rods project over the edge, said edge support means including a lateral projection on each of the support posts extending generally transversely outwardly from the plane of the frame member, said projections on the support posts having alignment surfaces in axial alignment with one another perpendicular to the plane of the frame member and engageable with the edge of a horizontal supporting surface, said alignment surfaces being perpendicular to a line bisecting the axes of the rods in the plane in which they are crossed.

5. A knife sharpening instrument comprising: an elongated generally arcuate and planar frame member, said frame member being bifurcated at one end thereof defining spaced support posts, a first abrasive rod having an axis mounted in one of the support posts, and a second abrasive rod having an axis mounted in the other support post so that the axes of the rods cross in at least one plane, said posts having converging surfaces in a direction away from the rods, defining an apex, said apex lying on a line bisecting the axes of the rods in the plane in which they are crossed so that the user may align the knife blade with respect to the apex during sharpening, said rods extending a substantial distance away from the frame member beyond the point where they cross so that a knife may be sharpened by directing the edge thereof toward the frame member, said frame member having a completely flat surface on at least one side thereof so it may be supported on a flat horizontal supporting surface, said frame member having a hand position extending transversely from the line bisecting the axes of the rods a significant distance so the user's hand may press the hand portion against the horizontal supporting surface without any part of the user's hand lying on the line bisecting the rods.

6. A knife sharpening instrument as defined in claim 5, wherein the frame member has an arcuate length at least three times the length of the rods so that the user's supporting hand on the frame member may be placed well away from the rods.

7. A knife sharpening instrument comprising: an elongated generally arcuate and planar frame member, said frame member being bifurcated at one end thereof defining spaced support posts, a first abrasive rod having an axis mounted in one of the support posts, and a second abrasive rod having an axis mounted in the other support post so that the axes of the rods cross in at least one plane, said posts having converging surfaces in a direction away from the rods, defining an apex, said apex lying on a line bisecting the axes of the rods in the plane in which they are crossed so that the user may align the knife blade with respect to the apex during sharpening, said frame member having edge support means for aligning the frame member with an edge of a horizontal supporting surface so that the rods project over the edge, the edge support means including a lateral projection on each of the support posts extending generally transversely outwardly from the plane of the frame member, the projections on the support posts having alignment surfaces in axial alignment with one another perpendicular to the plane of the frame member and engageable with an edge of a horizontal supporting surface, said alignment surfaces being perpendicular to a line bisecting the axes of the rods in the plane in which they are crossed.

8. A knife sharpening instrument comprising: an elongated generally arcuate and planar frame member, said frame member being bifurcated at one end thereof defining spaced support posts, a first abrasive rod having an axis one of the support posts, and a second abrasive rod having an axis the other support post so that the axes of the rods cross in at least one plane, said frame member being generally planar in configuration and having a planar surface on at least one side thereof so that the frame may be rigidly supported on a flat surface, said frame having an arcuate length of at least five inches so that the frame may be supported on a flat surface with light hand pressure, said rods extending a substantial distance away from the frame member beyond the point where they cross so that a knife may be sharpened by directing the edge thereof toward the frame member, said frame member having a completely flat surface on at least one side thereof so it may be supported on a flat horizontal supporting surface, said frame member having a hand portion extending transversely from a line bisecting the axes of the rods a significant distance so the user's hand may press the hand portion against the horizontal supporting surface without any part of the user's hand lying on the line bisecting the rods.

9. A knife sharpening instrument, comprising: an elongated generally arcuate and planar frame member, said frame member being bifurcated at one end thereof defining spaced support posts, a first abrasive rod having an axis mounted in one of the support posts, and a second abrasive rod having an axis mounted in the other support post so that the axes of rods cross in at least one plane, said frame member being generally planar in configuration and having a planar surface on at least one side thereof so that the frame member rigidly supported on a flat surface , said frame having an arcuate length of at least five inches so that the frame may be supported on a flat surface with light hand pressure, said frame member having edge support means for aligning the frame member with an edge of a horizontal supporting surface so that the rods project over the edge, the frame member an arcuate length at least three times the length of the rods so that the user's supporting hand on the frame may be placed well away from the rods, the edge support means including a lateral projection on each of the support posts extending generally transversely outwardly from the plane of the frame member, the projections on the support posts having alignment surfaces in axial alignment with one another perpendicular to the plane of the frame member and engageable with the edge of the horizontal supporting surface, said alignment surfaces being perpendicular to a line bisecting the axes of the rods in the plane in which they are crossed, said posts having converging surfaces in a direction away from the support posts, defining an apex, said apex lying on a line bisecting the axes of the support posts in the plane in which they are crossed so that the user may align the knife blade with respect to the apex during sharpening.

10. A knife sharpening instrument as defined in claim 1, including a plurality of integrally molded barbs on the frame member adjacent the rods to discourage the user from hand grasping the handle near the rods.

11. A knife sharpening instrument as defined in claim 1, including a fish hook grinding stone mounted in the frame member.

12. A knife sharpening instrument comprising: an elongated generally arcuate frame member, said frame member being bifurcated at one end thereof defining spaced support posts, a first one-piece abrasive rod mounted in one of the support posts, and a second one-piece abrasive rod mounted in the other support post so that the axes of the rods cross in at least one plane, said frame member having a pair of bores therein supporting the ends of the first and second rods, each of said rods having self-tapping threaded portions in said bores with a substantial portion of the threaded portion projecting from said bores, said bores having an inner unthreaded portion adjacent each of said rods with a smaller diameter than the outer diameter of the threaded portions, so that the user may rotate the rods to rotationally and axially shift one rod with respect to the other to expose fresh sharpening surfaces.

* * * * *